US006804842B1

(12) United States Patent
Johnson

(10) Patent No.: US 6,804,842 B1
(45) Date of Patent: Oct. 19, 2004

(54) WATERPROOF PORTABLE BATHING CHAIR

(76) Inventor: Almetta Johnson, 5863 Roswell St., San Diego, CA (US) 92114

( * ) Notice: Subject to any disclaimer, the term of this patent is extended or adjusted under 35 U.S.C. 154(b) by 0 days.

(21) Appl. No.: 10/761,026

(22) Filed: Jan. 20, 2004

(51) Int. Cl.[7] ..... A47K 3/022
(52) U.S. Cl. ..... 4/578.1; 4/579
(58) Field of Search ..... 4/573.1, 574.1, 4/575.1, 576.1, 577.1, 578.1, 579, 590

(56) References Cited

U.S. PATENT DOCUMENTS 2,483,077 A * 9/1949 Walsh ..... 4/561.1
3,408,107 A * 10/1968 Savage ..... 297/452.41
3,835,483 A 9/1974 Emery ..... 4/185
5,412,817 A 5/1995 Smith ..... 4/578.1
5,535,458 A * 7/1996 Siverly ..... 4/579
5,857,226 A * 1/1999 Sommer ..... 4/496
5,887,297 A 3/1999 Sutor ..... 4/578.1
6,378,147 B1 * 4/2002 Halleran ..... 4/579
6,691,337 B1 * 2/2004 Banks ..... 4/575.1

* cited by examiner

*Primary Examiner*—Gene Mancene
*Assistant Examiner*—Huyen Le
(74) *Attorney, Agent, or Firm*—Goldstein Law Offices, P.C.

(57) ABSTRACT

A waterproof portable bathing chair and footrest for use by a mobility-impaired person while taking a bath. The bathing chair is used to balance and support the user, and prevent the user from slipping while getting into and out of a bathtub, and also to cushion the user while relaxing in the bath. The bathing chair includes a cushioning seat, an upper body cushioning device attached to the seat and a headrest attached to the upper body cushioning device for comfortably supporting the neck and back of the user while bathing. A pair of armrests are coupled to the seat and fastened around a pair of handrails on the tub, for securing the user between the armrests on the seat cushion. The handrails, along with the footrest, provide the user with balance and safety while getting into and out of the bathtub.

5 Claims, 3 Drawing Sheets

WATERPROOF PORTABLE BATHING CHAIR

BACKGROUND OF THE INVENTION

The invention relates to a bathing chair for use by a mobility-impaired person, and more particularly, to a waterproof portable bathing chair having a backrest and a headrest for improved comfort, and a pair of handrails and a footrest for providing a safer and easier means for getting into and out of a bathtub.

Many mobility-impaired persons, such as the disabled or elderly, cannot take a shower in a traditional bathtub because they cannot stand for the substantial period of time required. Soaking in a bathtub, however, is a positive solution because it provides mobility-impaired people with a relaxation and comfort that is physically and mentally therapeutic, without having to stand for a long period of time. Even getting into and out of a traditional bathtub to take a bath, however, requires that the user be able to step over the front wall of the bathtub, sit down on the bottom surface of the tub, and lift themselves up and over the front wall when finished. The process of getting into and out of a bathtub alone, or even with the aid of others, makes taking a bath very difficult for mobility-impaired persons.

U.S. Pat. No. 3,835,483 to Emery discloses an inflatable seat with three upright sides for supporting a user in a bathtub. U.S. Pat. No. 5,412,817 to Smith discloses a seat assembly having a lip that overlies the front wall of the bathtub to assist disabled people. U.S. Pat. No. 5,887,297 to Sutor discloses an adjustable seat and frame assembly for use in a bathtub.

While these units may be suitable for the particular purpose employed, or for general use, they would not be as suitable for the purposes of the present invention as disclosed hereafter.

SUMMARY OF THE INVENTION

It is an object of the invention to produce a secure bathtub chair, which allows a mobility-impaired person safe and easy access when getting into and out of the bathtub. Accordingly, the bathtub chair of the present invention provides a pair of handrails and a footrest for helping a user balance while getting into and out of the bathtub. The footrest of the invention includes a foot rail having two ends. Each end is attached to a compressible spring and suction cup, which together allow the footrest to adjust and fit securely between the bathtub walls.

It is another object of the invention to produce a comfortable and relaxing bathtub chair. Accordingly, the bathtub chair has a cushioning seat, an upper body cushioning device, and a headrest.

It is another object of the invention to produce a bathtub chair that is easily portable. Accordingly, the invention provides a lightweight waterproof bathtub chair, with a flexible upper body cushioning device, a headrest, and a pair of armrests that flexibly fold together for easy packaging and portability.

Yet another object of the invention is to produce a bathtub chair having a replaceable decorative cover. Accordingly, the invention has a replaceable waterproof cover for concealing the seat, the upper body cushioning device, the headrest, and the armrests.

The invention is a waterproof portable bathing chair and footrest for use by a mobility-impaired person in a bathtub.

The chair and footrest help balance and support a user while getting into and out of the bathtub. The chair includes a pair of armrests that each attach to the sides of the seat and secure around a handrail. The pair of handrails, along with the footrest, provide much needed safety and balance to the user. In addition, the bathing chair includes a cushioning seat, an upper body cushioning device attached to the seat and a headrest attached to the upper body cushioning device for comfortably supporting the user while relaxing in the bathtub.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
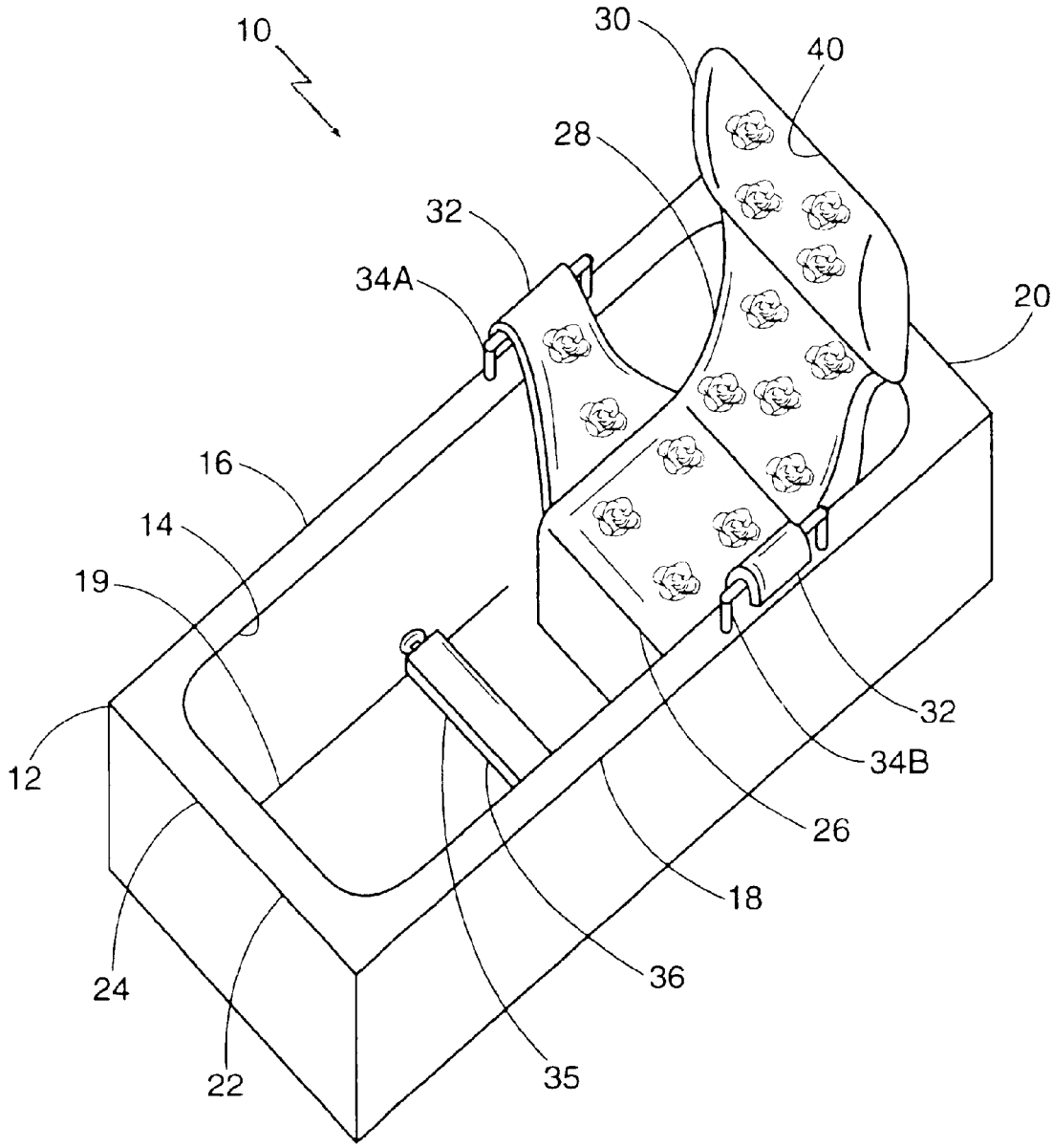
FIG. 1 is a diagrammatic perspective view of the present invention, showing a waterproof bathing chair according to the present invention positioned within a bathtub.

FIG. 1 illustrates a lightweight and waterproof portable bathing chair 10 for use by a mobility-impaired person, such as a disabled or an elderly person, in a conventional bathtub 12. The bathtub 12 supports the chair 10 while a user having a neck, a back, and a pair of feet, bathes therein. The bathtub 12 has an elongated tub 14 that is defined by a front wall 16, an opposite a back wall 18, and a bottom surface 19 extending there between. The front wall 16 and the back wall 18 are integrally coupled to and connected by a first sidewall 20 and a second sidewall 22, which together define a horizontal upper edge 24 of the bathtub 12.

The bathing chair 10 is made of durable plastic and foam rubber and includes a cushioning seat 26 for supporting the user while seated thereon. The cushioning seat 26 rests on the bottom surface 19 of the tub 14 adjacent to the first sidewall 20 and is thick enough to elevate the user substantially above the bottom surface 19 of the tub 14. The cushioning seat 26 is coupled to an upper body cushioning device 28 which extends along the first sidewall 20 of the tub 14 for cushioning the back of the user. The upper body cushioning device 28 is attached to a headrest 30 for supporting and cushioning the neck of the user. In addition, the chair 10 includes a footrest 35 having an elongated foot rail 36 that is positioned in front of the cushioning seat 26 slightly above the bottom surface 19 of the tub 14. The footrest 35 is securely fastened between the front wall 16 and the back wall 18 of the tub 14 and lends additional support to the user while getting into and out of the bathtub 12. The footrest 35 also supports the user while in the cushioning seat 26 by allowing the user to rest their feet securely against the rail 36.

Further, the chair 10 includes a pair of armrests 32, which attach to the cushioning seat 26 and secure to a front handrail and a back handrail 34A and 343. The handrails 34A and 34B each secure to the horizontal upper edge 24 of the bathtub 12, opposite from one another. The front handrail 34A is secured to the horizontal upper edge 24 of the front wall 16 opposite from a back handrail 34B, which is secured to the horizontal upper edge 24 of the back wall 18. The handrails 34A and 34B provide the user with added safety while getting into and out of the bathtub 12. The upper body cushioning device 28, the headrest 30, and the pair of armrests 32 are all made of waterproof flexible plastic and foam rubber, so that the chair is easily foldable for convenient packaging and portability. Furthermore, the bathing chair 10 is fit for use in bathtubs and whirlpool tubs of all shapes and sizes. The portable bathing chair 10 is also shown having one of many replaceable decorative covers 40. The covers 40 are made of clear plastic for decorating and concealing most of the seat 26, the upper body cushioning device 28, the headrest 30, and the armrests 32.

Figure 2:
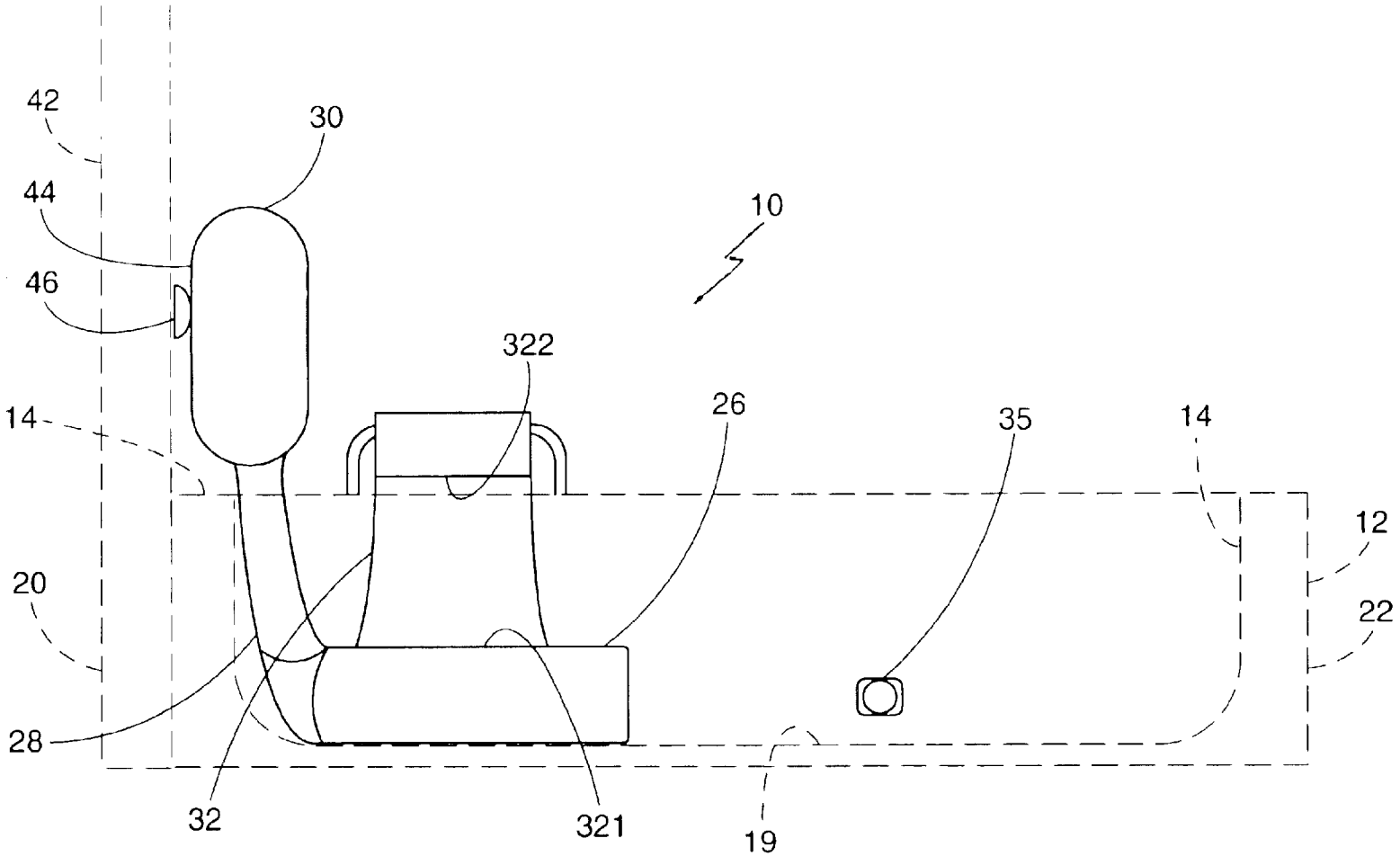
FIG. 2 is a side elevational view of the present invention illustrating the location of the bathing seat on a bottom surface of the bathtub adjacent to a first sidewall.

FIG. 2 illustrates the portable bathing chair 10 according to the present invention, positioned within the tub 14. The seat 26 is properly placed on the bottom surface 19 of the tub 14, close enough to the first sidewall 20 so that the upper body cushioning device 28 extends along the first sidewall 20 and rests against the horizontal upper edge 24 of the bathtub 12. According to the preferred embodiment, the first sidewall 20 is adjacent to a bathroom wall 42. The headrest 30, which may be fan-shaped, has a back surface 44 and a plurality of suction cups 46 that attach to the back surface 44 of the headrest 30. In this embodiment, the suction cups 46 are coupled to the bathroom wall 42 and hold the headrest securely against the wall 42 thereby comforting and supporting the neck of the user. However, in another example, the headrest may secure to an adjacent glass door, a mirrored wall, or the upper edge of the tub. The pair of armrests 32 each have a first edge 321 and a second edge 322. Here, the footrest 35 of the present invention is positioned in between the seat 26 and the second sidewall 22. The footrest 35 is further located slightly above the bottom surface 19 of the tub 14 for helping to balance the feet of the user, by preventing the user from slipping, while getting into and out of the bathtub 12.

Figure 3:
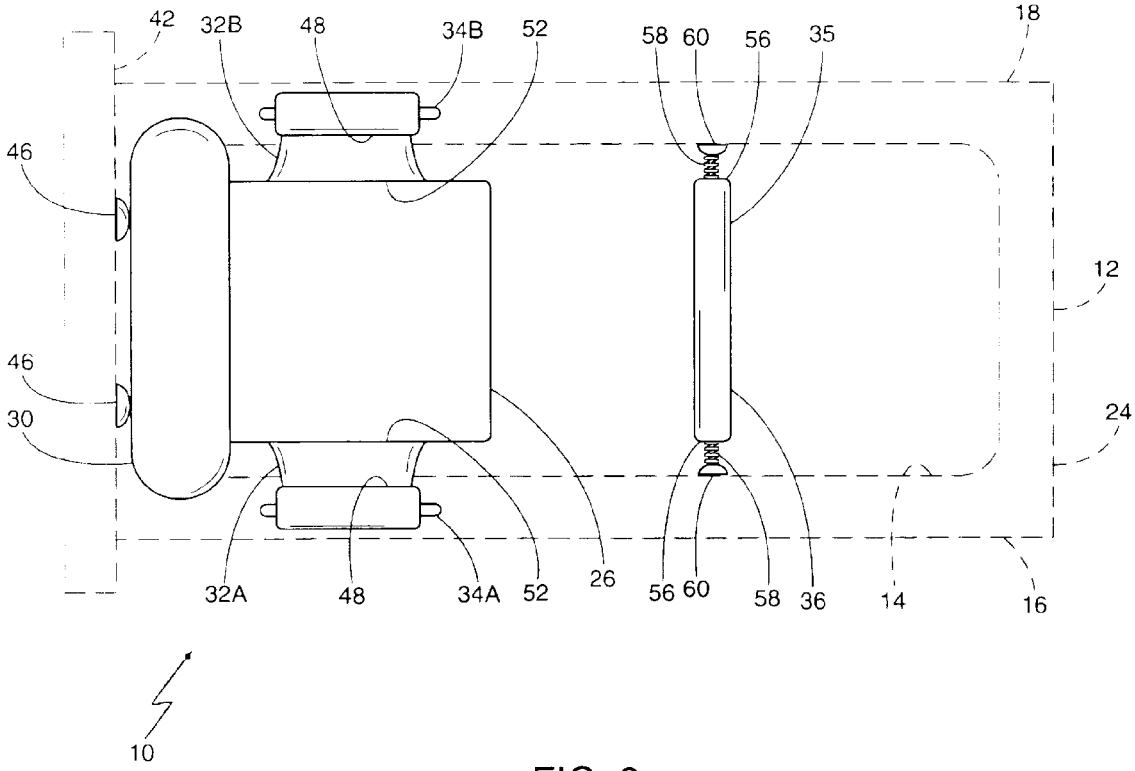
FIG. 3 is a top elevational view of the present invention showing the bathing chair and a footrest positioned between a front wall and a back wall of the bathtub.

FIG. 3 illustrates the chair 10 of the present invention, including the headrest 30, the seat 26, having a pair of lateral sides 52, and the pair of armrests 32. The headrest 30 shown is coupled to the bathroom wall 42 by the suction cups 46. Each armrest 32 is attached at its first edge 321 to one of the lateral sides 52 of the seat. The pair of armrests 32 are each secured at its second edge 322 around the handrails 34A and 34B, which are attached to the horizontal upper edges 24 of the bathtub 12. The pair of armrests 32 include a front armrest 32A which corresponds to the front handrail 34A. The front armrest 32A, for example, attaches to the side 52 of the seat 26, and extends up and along the inside wall 16 of the tub 14 to fasten tightly around the corresponding handrail 34A before attaching to itself at a fastening means 48. The handrails 34A and 34B are parallel one another, the front handrail 34A on the edge 24 of the front wall 16 of the bathtub 12, and the back handrail 34B on the edge 24 of the back wall 18 of the bathtub 12. The fastening means 48 may include a hook and loop fastener or a snapping mechanism. The armrests 32 provide the user with increased support and stability while seated in the chair 10. The handrails 34A and 34B also provide the user with increased support by allowing the user to grasp the handrails 34A and 34B for balance.

In addition, the footrest 35 is attached to the walls 16 and 18 of the tub 14. The footrest 35 includes a foot rail 36 having two ends 56. Each end 56 is attached to a compressible spring 58, which is coupled to a single suction cup 60. The single suction cup 60 secures the foot rail 36 to the inside walls 16 and 18 of the tub 14. The compressible springs 58 permit the foot rail 36 to fit securely within the space between the front wall 16 and the back wall 18 just above the bottom surface of the tub 14. Once secured in place, the footrest 35 balances and supports the user, by preventing the user from slipping, while getting into and out of the bathtub 12.

In conclusion, herein is presented a waterproof portable bathing chair for use by a mobility-impaired person while bathing. The invention is illustrated by example in the drawing figures, and throughout the written description. It should be understood that numerous variations are possible, while adhering to the inventive concept. Such variations are contemplated as being a part of the present invention.

What is claimed is:

1. A waterproof portable bathing chair, for use by a mobility-impaired person in a conventional bathtub, having a tub defined by a bottom surface, a front wall opposite a back wall, and integrally coupled first and second sidewalls extending there between, wherein said first sidewall is adjacent to a bathroom wall, said walls together defining a horizontal upper edge of the tub, comprising:

a cushioned seat having a backside, a left side, and a right side, wherein the cushioned seat is positionable on the bottom surface of the tub in a centered position;

a headrest having a back surface and a plurality of suction cups attached to the back surface for securing the headrest to the bathroom wall;

an upper body cushioning device coupled to the backside of the seat and having a top edge secured to the headrest, wherein said cushioning device is used to support the user while relaxing in the chair;

a pair of handrails, including a front handrail and a back handrail, wherein the front handrail is securable to the horizontal edge of the front wall opposite from the back handrail which is securable to the horizontal edge of the back wall;

a pair of armrests, including a front armrest and a back armrest, each having a first edge that is attached to the handrail and a second edge that extends laterally from the seat; and an elongated adjustable foot rail having two ends that are spring-biased away from each other and each have a suction cup for-securing said foot rail inside the tub between and against the front wall and the back wall.

2. The portable bathing chair of claim 1, having a replaceable decorative cover for concealing the seat, the upper body cushioning device, the headrest, and the armrests.

3. The portable bathing chair of claim 1, wherein the seat is made out of foam rubber.

4. The portable bathing chair of claim 1, wherein the headrest is fan-shaped.

5. The portable bathing chair of claim 1, wherein the spring is compressible.

* * * * *